US010037749B2

(12) United States Patent
Glasser et al.

(10) Patent No.: US 10,037,749 B2
(45) Date of Patent: Jul. 31, 2018

(54) APPARATUS AND METHODS FOR A COLLAPSIBLE STAND FOR A STRINGED INSTRUMENT

(71) Applicants: Andrew Glasser, Bronx, NY (US); Felix Chen, La Verne, CA (US)

(72) Inventors: Andrew Glasser, Bronx, NY (US); Felix Chen, La Verne, CA (US)

( * ) Notice: Subject to any disclaimer, the term of this patent is extended or adjusted under 35 U.S.C. 154(b) by 7 days.

(21) Appl. No.: 15/609,624

(22) Filed: May 31, 2017

(65) Prior Publication Data

US 2018/0005613 A1 Jan. 4, 2018

Related U.S. Application Data

(60) Provisional application No. 62/343,570, filed on May 31, 2016.

(51) Int. Cl.
*G10G 5/00* (2006.01)

(52) U.S. Cl.
CPC ..... *G10G 5/005* (2013.01)

(58) Field of Classification Search
CPC ..... G10D 5/00; G10G 5/005
See application file for complete search history.

(56) References Cited

U.S. PATENT DOCUMENTS

| | | | | |
|---|---|---|---|---|
| 637,273 | A | 11/1899 | Miller | |
| 1,170,684 | A | 2/1916 | Schlieckert | |
| 2,502,229 | A | 3/1950 | Miller | |
| 2,630,289 | A | 3/1953 | Selig | |
| 4,546,688 | A | 10/1985 | Cuccio | |
| 6,316,706 | B1 | 11/2001 | Sammons | |
| 6,439,532 | B1 | 8/2002 | Yu | |
| 6,576,822 | B1 | 6/2003 | Grace | |
| 6,585,315 | B1 | 7/2003 | Vail | |
| 7,342,162 | B2 | 3/2008 | Tai | |
| 8,796,525 | B2 | 8/2014 | Sawhney | |
| 2004/0149119 | A1 | 8/2004 | Kalbas | |
| 2006/0162529 | A1* | 7/2006 | Hsieh | F16M 11/16 84/327 |
| 2009/0229445 | A1* | 9/2009 | Courtright | G10D 1/005 84/453 |
| 2015/0267859 | A1* | 9/2015 | Carpenter | F16M 11/24 248/411 |

* cited by examiner

*Primary Examiner* — Kimberly Lockett

(74) *Attorney, Agent, or Firm* — J. Curtis Edmondson; Anitha Shankar Narayan; Law Offices of J. Curtis Edmondson

(57) ABSTRACT

A collapsible and height adjustable stand for a stringed musical instrument is described; specifically, a compact, portable and customizable stand for holding stringed instruments in a secure upright position. The stand can be easily used and also collapsed back quickly after use. Padding on the top and bottom cradle handles holds the instrument and cushions the stringed instruments. Also, a bow hook attached to the upper part of the stand allows for hanging the bow. The adjustable height feature allows the stand to hold musical stringed instruments of different sizes.

11 Claims, 7 Drawing Sheets

APPARATUS AND METHODS FOR A COLLAPSIBLE STAND FOR A STRINGED INSTRUMENT

REFERENCE TO RELATED APPLICATIONS

This application claims an invention which was disclosed in Provisional Application No. 62/343,570, filed May 31, 2016, entitled "Apparatus and Methods for Collapsible Stand for a Stringed Musical Instrument". The benefit under 35 § 119(e) of the United States provisional application is hereby claimed, and the aforementioned application is hereby incorporated herein by reference.

FIELD

The inventive subject matter relates to apparatus and methods for a collapsible stand for a musical instrument; specifically, a compact, portable and a height adjustable stand for holding a stringed instrument in a secure upright position.

BACKGROUND

Musicians of stringed instruments such as guitars, violins often find it desirable to utilize. An instrument stand to instantly and temporarily support an instrument when it is not in use. The instrument stand protects the instrument and allows an access to the instrument. An instrument stand also eliminates the need to retrieve the instrument from an instrument case.

A variety of mechanical supports have been proposed in the art for different stringed musical instruments as follows. U.S. Pat. No. 637,273 issued to Miller describes a machine which can support and play a guitar without using hands. U.S. Pat. No. 1,171,684 issued to Schlickert describes a improved violin supporting attachment for general music stands. U.S. Pat. No. 2,502,229 issued to Miller describes a stand for a bass viola, particularly a double bass. U.S. Pat. No. 2,630,289 issued to Selig describes a means for supporting a bass violin in the playing position so that the hands of the player are free. U.S. Pat. No. 4,546,688 issued to Cuccio describes a holder for a stringed instrument with an annular cradle and a male prong attached thereto. U.S. Pat. No. 6,316,707 issued to Sammons describes a multi-purpose entertainer stand comprising a central mast and a base. U.S. Pat. No. 6,439,532 issued to Yu describes a guitar stand with a foldable support frame with a support block and a fastening device. U.S. Pat. No. 6,576,822 issued to Grace describes a stand to support a stringed instrument in an upright position and also protecting the instrument from inadvertent rotation. U.S. Pat. No. 6,585,315 issued to Vail describes a foldable stool and stringed instruments stand which can easily ported. U.S. Pat. No. 7,342,162 issued to Tai describes musical instrument stand and a musical instrument hanger that are portable and compact.

Accordingly, there remains a continued need for improved designs for a musical instrument stand that is sturdy, lightweight, easily configurable and portable. It is to these and other improvements that preferred embodiments of the present inventive subject matter are generally directed.

SUMMARY

Described is a collapsible stand for a stringed musical instrument, specifically a compact, portable and customizable stand for holding stringed instruments in a secure upright position. The stand can be easily setup and collapsed back quickly after use. Padding on the upper and lower cradle handles that hold the instrument offers the cushioning. Also, a bow hook allows for hanging the bow. The adjustable height of the stand accommodates musical stringed instruments varied heights.

These and other embodiments are described in more detail in the following detailed descriptions and the figures. The foregoing is not intended to be an exhaustive list of embodiments and features of the present invention. Persons skilled in the art are capable of appreciating other embodiments and features from the following detailed description in conjunction with the drawings.

REFERENCE CHARACTERS

Figure 1:
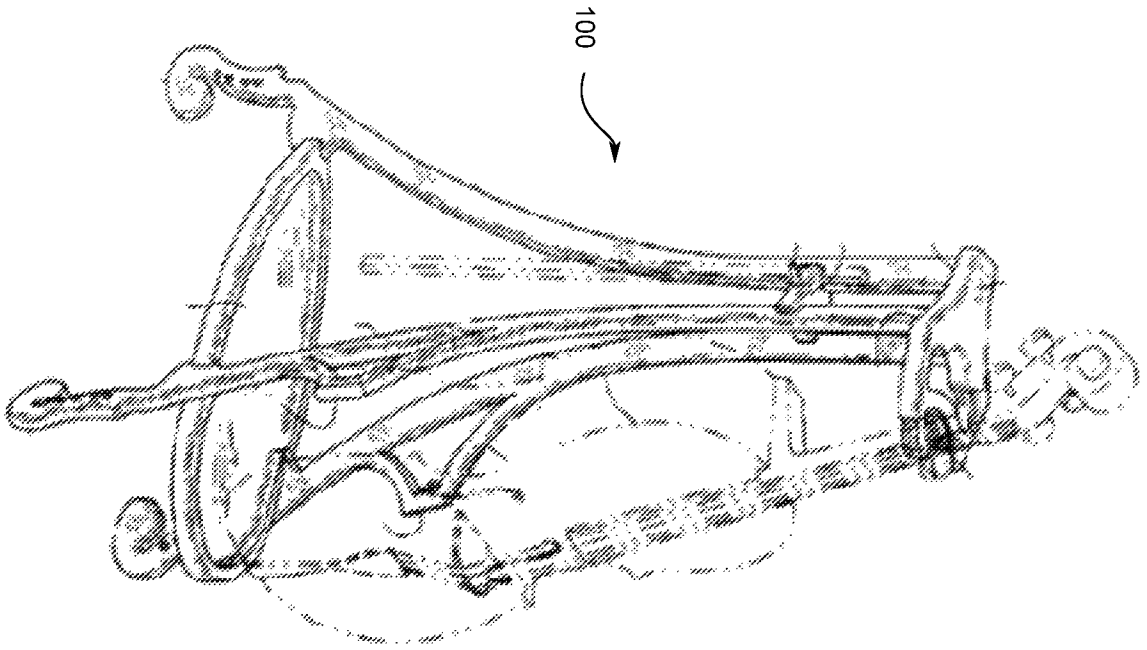
PRIOR ART FIG. 1
FIG. 1 illustrates a prior art musical stand.

100 Prior art Musical Instrument Stand
200 Illustrates a perspective view.
210 Support legs
215 End fittings for support legs
220 Connectors
225 Hinge
230 Leg of inverse V-shaped stand
235 Lower cradle handles
240 end fittings for lower cradle handles
250 Vertex of inverse V-shaped stand
255 Latch for height adjustment
260 Vertical tube
265 Upper bracket
270 Upper Cradle Handle
275 Small snap gate
280 Bow hook Stopper
285 Bow aperture clamp
290 Bow hook
300 and 400 Illustrates a left side and right side view.
500 Illustrates a height reduced view.
600 Illustrates a retracted view.
700-780 Describes flow chart.

DETAILED DESCRIPTION

The benefits of the inventions are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the inventions to the exact construction and operation illustrated and described herein. Accordingly, all suitable modifications and equivalents should be understood to fall within the scope of the inventions as claimed herein.

A prior art stand 100 for stringed musical instruments is as shown in FIG. 1. The prior art stands are made of wood and have a pair of arched braces terminating in a triangle of support at the bottom of the stand.

Figure 2:
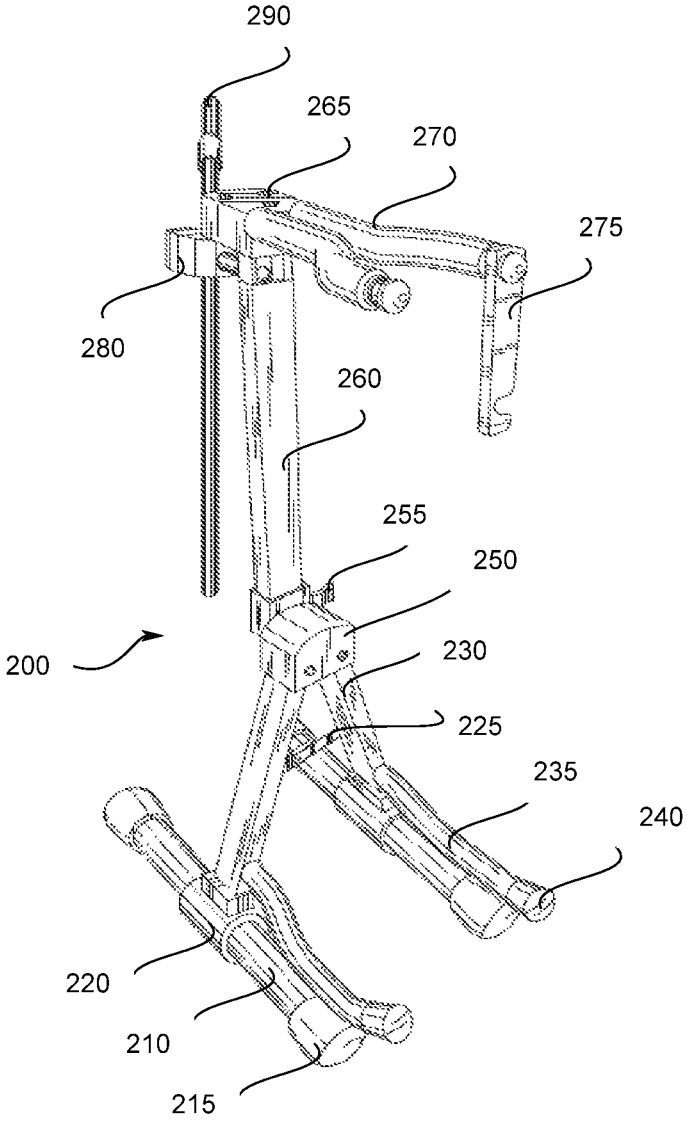
FIG. 2 illustrates a perspective view of a musical instrument stand.

Now referring to FIG. 2, which shows a perspective view 200 of an open configuration. The stringed musical instrument stand can be termed as a frame stand having an upper and lower portion of a robust mast to host a stringed musical instrument. The lower portion of the mast has an inverse V-shaped stand 230 having its vertex at 250, ending with a pair of legs 210 through securement connectors 220. The legs are fitted with anti-scratch end fittings 215. Further the inverse V-shaped stand are attached with a pair of lower cradle handles 235 fitted with anti-scratch end fittings 240 and padded with rubber foam to host the lower part of the stringed instrument. The two legs of the inverse V-shaped stand is connected with a hinge 225 which helps in folding the stand to a compact structure, when not in use.

At the rear end of the inverse V-shaped stand's vertex 250 is attached a latch 255 to adjust the height of the upper portion of the mast by adjusting the length of the elongated vertical tube 260. The vertical tube 260 ends with an upper vertex or bracket 265, which at a front end holds the upper cradle handles 270 and at the rear end has an aperture clamp 285 (shown in FIG. 3 and FIG. 4) capable of receiving a bow 290. Just below the aperture clamp 285 is present a bow holder stopper 280 to hold the bow holder in a vertical position. The two ends of the upper cradle handle 270 end up in a simple snap gate 275 to make way for the upper portion of the stringed instrument and by locking the snap gate 275 to lock position, one can secure the stringed instruments in the lower and upper handle of the cradle. The bow holder can be affixed at a given height by using the bow holder stopper 280.

Figure 3:
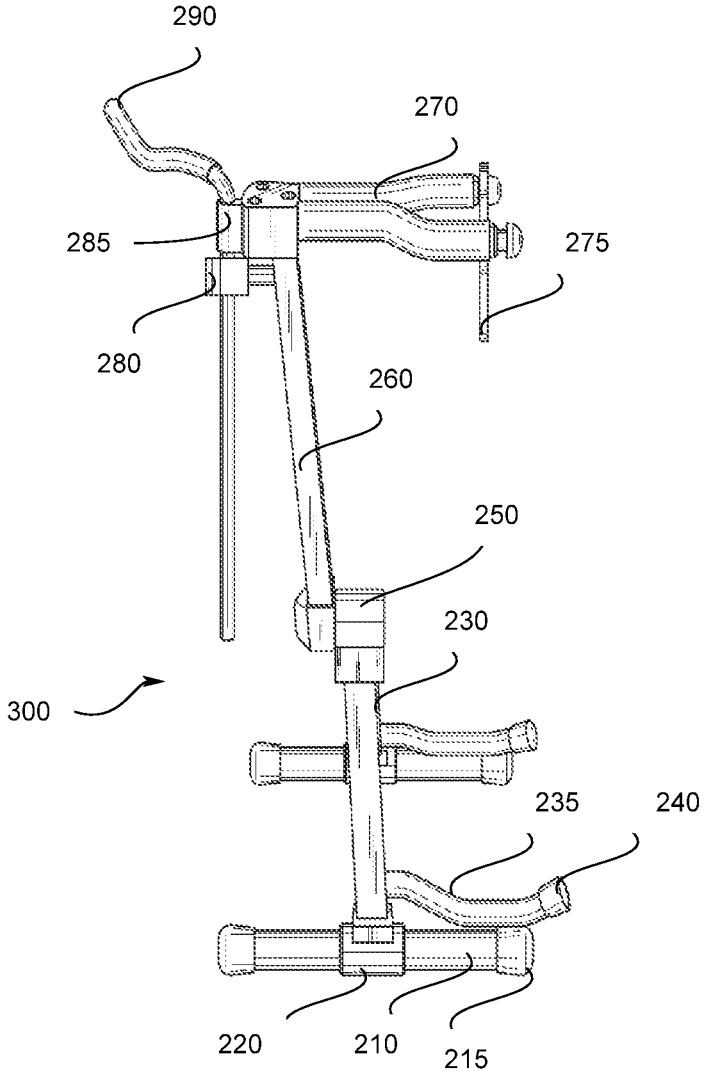
FIG. 3 illustrates a left side view of the musical instrument stand.
Figure 4:
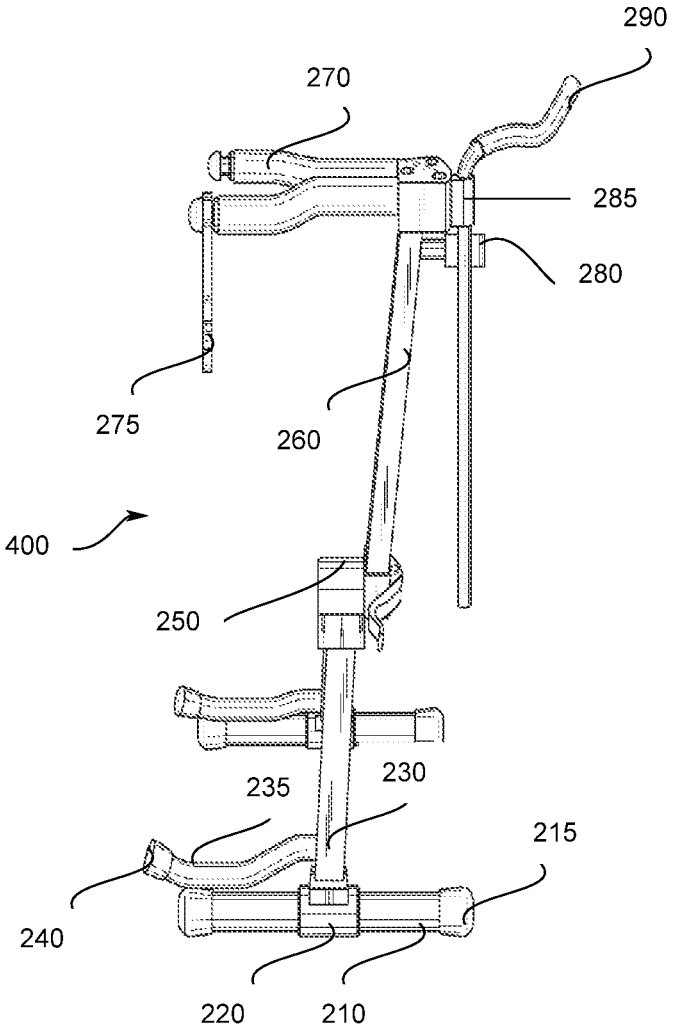
FIG. 4 illustrates a right-side view of the musical instrument stand.

FIG. 3 and FIG. 4 and illustrates left side view 300 and right side view 400 of the musical instrument stand described in 100 for its open configuration.

Figure 5:
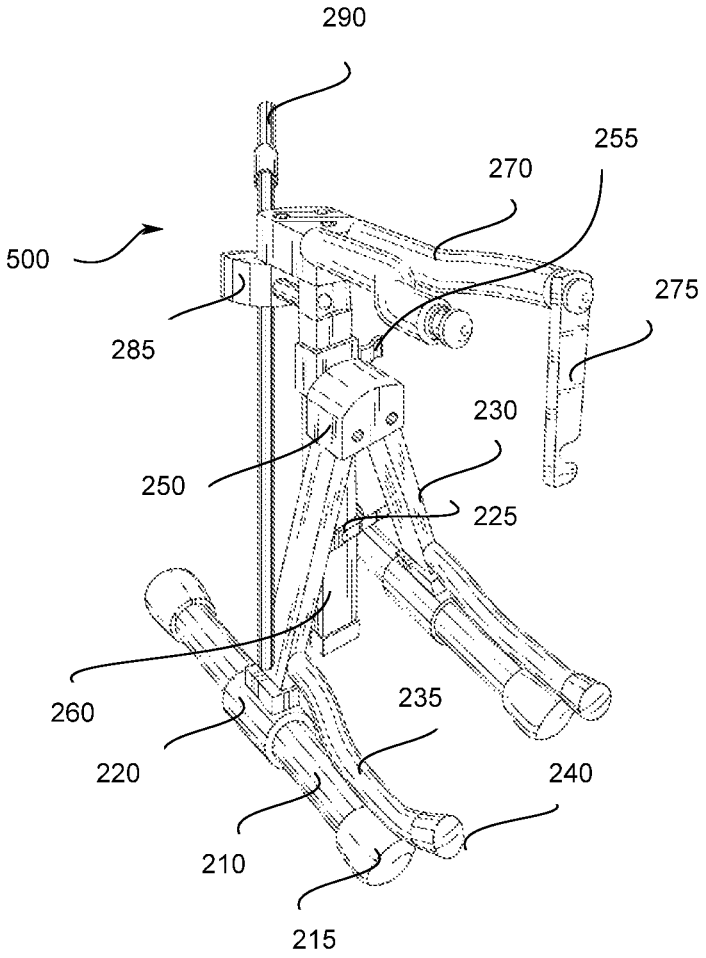
FIG. 5 illustrates a height reduced view of the musical instrument stand.

FIG. 5 illustrates a vertically height reduced configuration view 500 of the musical instrument stand described in 100. The vertically height reduced configuration can be achieved by opening the latch 255 and dropping the vertical tube 260 down the latch.

Figure 6:
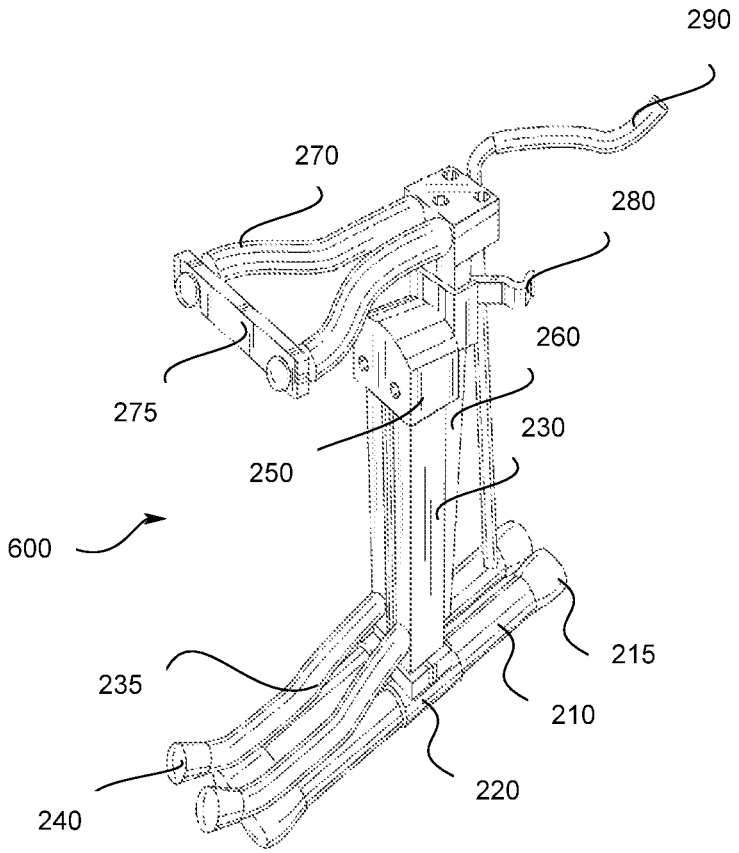
FIG. 6 illustrates a retracted view of the musical instrument stand.

FIG. 6 illustrates a retracted configuration view 600 of the musical instrument stand described in 100. The retracted configuration can be achieved by initially by opening the latch 255 and dropping the vertical tube 260 down the latch and then folding the hinge 225 on the lower portion of the mast to bring the pair of legs of the inverse –V shaped stand next to each other.

Figure 7:
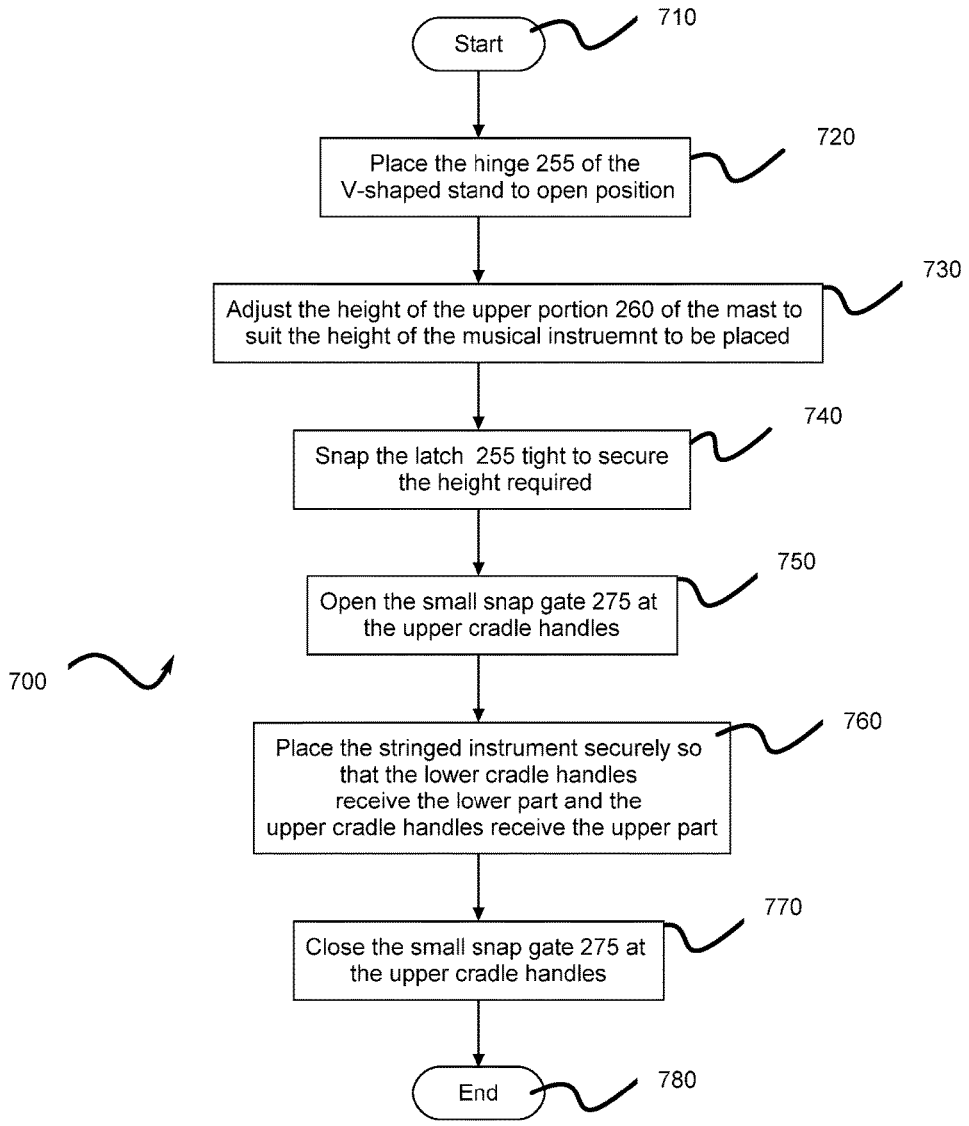
FIG. 7 illustrates a flow chart for securing a stringed musical instrument on the stand.

FIG. 7 describes a flow chart 700 for the process of securing a stringed musical instrument in the stand as described in the inventive subject matter. The process is started 710 by placing the hinge 225 of the Inverse V-shaped stand to open position 720. Then the upper portion of the mast is adjusted to a desirable height 730. The height desired is secured by snapping the latch 255 tight 740. The small snap gate 275 at the upper cradle handle is opened 750 and the stringed instrument is securely placed so that the lower cradle handles receive the lower part of the stringed instrument and the upper part of the stringed instrument is rested in the upper cradle handles 760. The small snap gate 275 at the upper cradle handles is closed 770 and thus the stringed instrument is securely placed in the stand.

After use if the stand needs to be folded then, first the stringed instrument is carefully removed from the stand by opening the small snap gate 275 at the upper cradle handle and placed in an instrument case, second the upper portion of the mast is collapsed to half its height with the help of the latch 255 for the vertical tube 260, lastly the hinge 225 is compressed so that the inverse V-shaped stand folds up compactly. Thus, the musical instrument stand described in the inventive subject matter is collapsed to half its height for a compact portable structure.

In a preferred embodiment, the open configuration has the following overall dimensional features. The height of the musical instrument stand ranges between 19.0-21.0 inches. spacing between the legs ranging between 6.0-8.0 inches and breadth ranging between 9.0-11.0 inches. The retracted configuration has the following overall dimensional features. The height ranging between 11.0-13.0 inches, spacing between the legs ranging between 0.2-0.3 inches and breadth ranging between 9.0-11.0 inches. Hence the musical instrument stand can be collapsed to a structure having nearly half its original height and at a least spacing between the legs.

In a preferred embodiment, a collapsible stand for a stringed musical instrument is described. Which further has an upper portion, the upper portion hosting a pair of upper cradle handle and a lower portion, the lower portion hosting a pair of lower cradle handle, a latch for adjusting a vertical height of the upper portion in reference to the lower portion and a hinge for collapsing the lower portion to a compact structure. The upper portion receives a top portion of the stringed musical instrument and the lower portion receives a bottom portion of the stringed musical instrument. The stand can be used with varied types of stringed musical instrument namely viola, violin, cello and guitar. The lower portion of the musical instrument stand has an inverse-V shaped structured stand standing on a pair of legs and the upper portion has a bow hook aperture and bow hook stopper. The upper portion and lower portion can be made of metallic material, plastic material or wood material. Further, the upper and power cradle handles are covered with cushion material.

It should be appreciated by those of ordinary skill that the specific structural and material configurations of the musical instrument stand described are exemplary only. Other design configurations may be used that generally fall within the spirit and scope of the present disclosure. The musical instrument stand can be built by a varied type of materials, including, light weight metals, wood, and plastic. The protective covers on the cradle handles can be made of varied type of materials including, foam, rubber or any cushion materials.

The invention claimed is:

1. A collapsible stand for a stringed musical instrument comprising:

an upper portion, the upper portion hosting a pair of upper cradle handle;

a lower portion, the lower portion hosting a pair of lower cradle handle, a latch for adjusting a vertical height of the upper portion in reference to the lower portion and a hinge for collapsing the lower portion to a compact structure and;

the upper portion hosting a bow hook aperture and bow hook stopper.

2. The collapsible stand for a stringed musical instrument as described in claim 1, wherein the upper portion receives a top portion of the stringed musical instrument.

3. The collapsible stand for a stringed musical instrument as described in claim 1, wherein the lower portion receives a bottom portion of the stringed musical instrument.

4. The collapsible stand for a stringed musical instrument as described in claim 1, wherein the stand can be used for a stringed musical instrument chosen from a group including viola, violin, cello and guitar.

5. The collapsible stand for a stringed musical instrument as described in claim 1, wherein the lower portion has an inverse-V shaped structured stand standing on a pair of legs.

6. The collapsible stand for a stringed musical instrument as described in claim 1, further wherein the upper portion and the lower portion are made of metallic material.

7. The collapsible stand for a stringed musical instrument as described in claim 1, further wherein the upper portion and the lower portion are made of plastic material.

8. The collapsible stand for a stringed musical instrument as described in claim 1, further wherein the upper portion and the lower portion are made of wood material.

9. The collapsible stand for stringed musical instrument as described in claim 1, wherein the upper and power cradle handles are covered with cushion material.

10. The collapsible stand for a stringed musical instrument as described in claim 1, wherein an open configuration has overall dimensional features including, height ranging between 19.0-21.0 inches. spacing between the legs ranging between 6.0-8.0 inches and breadth ranging between 9.0-11.0 inches.

11. The collapsible stand for a stringed musical instrument as described in claim 1, wherein a retracted configuration overall dimensional features including height ranging between 11.0-13.0 inches, spacing between the legs ranging between 0.2-0.3 inches and breadth ranging between 9.0-11.0 inches.

* * * * *